US007874754B1

(12) United States Patent
Ammons et al.

(10) Patent No.: US 7,874,754 B1
(45) **Date of Patent: *Jan. 25, 2011**

(54) DRIP CONTAINING CONTAINER WITH TEAR-AWAY WIPER ELEMENT

(75) Inventors: James Ammons, 1420 Lawrence Rd., Kemah, TX (US) 77565; Ronald Allan Ammons, Livingston, TX (US)

(73) Assignee: James Ammons, Kemah, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/544,953

(22) Filed: Aug. 20, 2009

(51) Int. Cl.

| | |
|---|---|
| ***A46B 17/08*** | (2006.01) |
| ***A46B 11/00*** | (2006.01) |
| ***A45D 33/00*** | (2006.01) |
| ***A47G 19/00*** | (2006.01) |
| ***B65D 21/02*** | (2006.01) |
| ***B65D 25/00*** | (2006.01) |
| ***B65D 1/40*** | (2006.01) |
| ***B65D 3/28*** | (2006.01) |
| ***B05C 17/00*** | (2006.01) |
| ***B44D 3/00*** | (2006.01) |
| ***B44D 3/04*** | (2006.01) |

(52) U.S. Cl. ..... 401/122; 401/121; 401/126; 401/130; 220/23.9; 220/733; 220/919; 206/1.7; 206/1.8; 206/1.9

(58) Field of Classification Search ..... 401/121, 401/122, 126, 130; 220/23.87, 23.9, 273, 220/495.01, 495.02, 510, 571.1, 630, 733, 220/919; 206/1.7, 1.8, 1.9, 81
See application file for complete search history.

(56) References Cited

U.S. PATENT DOCUMENTS

| | | | | |
|---|---|---|---|---|
| 332,043 | A * | 12/1885 | Brien | 220/698 |
| 1,696,240 | A * | 12/1928 | Kircher, Jr. | 220/797 |
| 2,313,059 | A * | 3/1943 | Freeman | 220/797 |
| 3,326,409 | A * | 6/1967 | Speer | 220/698 |
| 5,577,632 | A * | 11/1996 | Blanchette | 220/792 |
| 5,779,093 | A * | 7/1998 | Poole et al. | 220/698 |
| 7,150,378 | B2 | 12/2006 | Dean et al. | |
| 2007/0102435 | A1 * | 5/2007 | Fera | 220/735 |
| 2009/0092436 | A1 | 4/2009 | Mercier | |

* cited by examiner

*Primary Examiner*—Gregory L Huson
*Assistant Examiner*—Ryan A Varnum
(74) *Attorney, Agent, or Firm*—Buskop Law Group, PC; Wendy Boskop

(57) ABSTRACT

A drip containing one-piece container for use with a fast curing solvent welding liquid, wherein the container comprises a body, a top, a first and second wall end, and a bottom. The container further comprises a neck, a dauber cap, at least two extensions, and a wiper disposed between the extensions. The dauber cap further comprises a stem extending from the lid and a dauber applicator connected to the stem, wherein the dauber applicator and the stem are stored within the container. The dauber applicator retrieves a portion of the fast curing solvent welding liquid through an openings and the wiper removes portions of the fast curing solvent welding liquid allowing the fast curing solvent welding liquid to fall back into the body of the container and keep the removed portions of the fast curing solvent welding liquid from dripping externally to the container.

10 Claims, 5 Drawing Sheets

DRIP CONTAINING CONTAINER WITH TEAR-AWAY WIPER ELEMENT

FIELD

The present embodiments generally relate to a drip containing one-piece container for use with a fast curing solvent welding liquid that can retrieve a portion of the fast curing solvent welding liquid through an opening and a wiper can remove portions of the fast curing solvent welding liquid not being used, allowing the fast curing solvent welding liquid to fall back into the body of the container and keep the removed portions of the fast curing solvent welding liquid from dripping externally to the container.

BACKGROUND

A need exists for a container that prevents dripping and spilling of fast curing liquid adhesive which can be made by an easy metal stamping process with one stamp.

A need exists to prevent spilling of fast curing liquid adhesives or paints that can leak toxic emissions into the environment due to dripping and spilling of these liquids and materials.

A further need exists for a wiper formed in a container that enables the reduction of pollution because of a reduced need to replace the liquid and/or container because of spillage.

BRIEF DESCRIPTION OF THE DRAWINGS

The detailed description will be better understood in conjunction with the accompanying drawings as follows.

Figure 1:
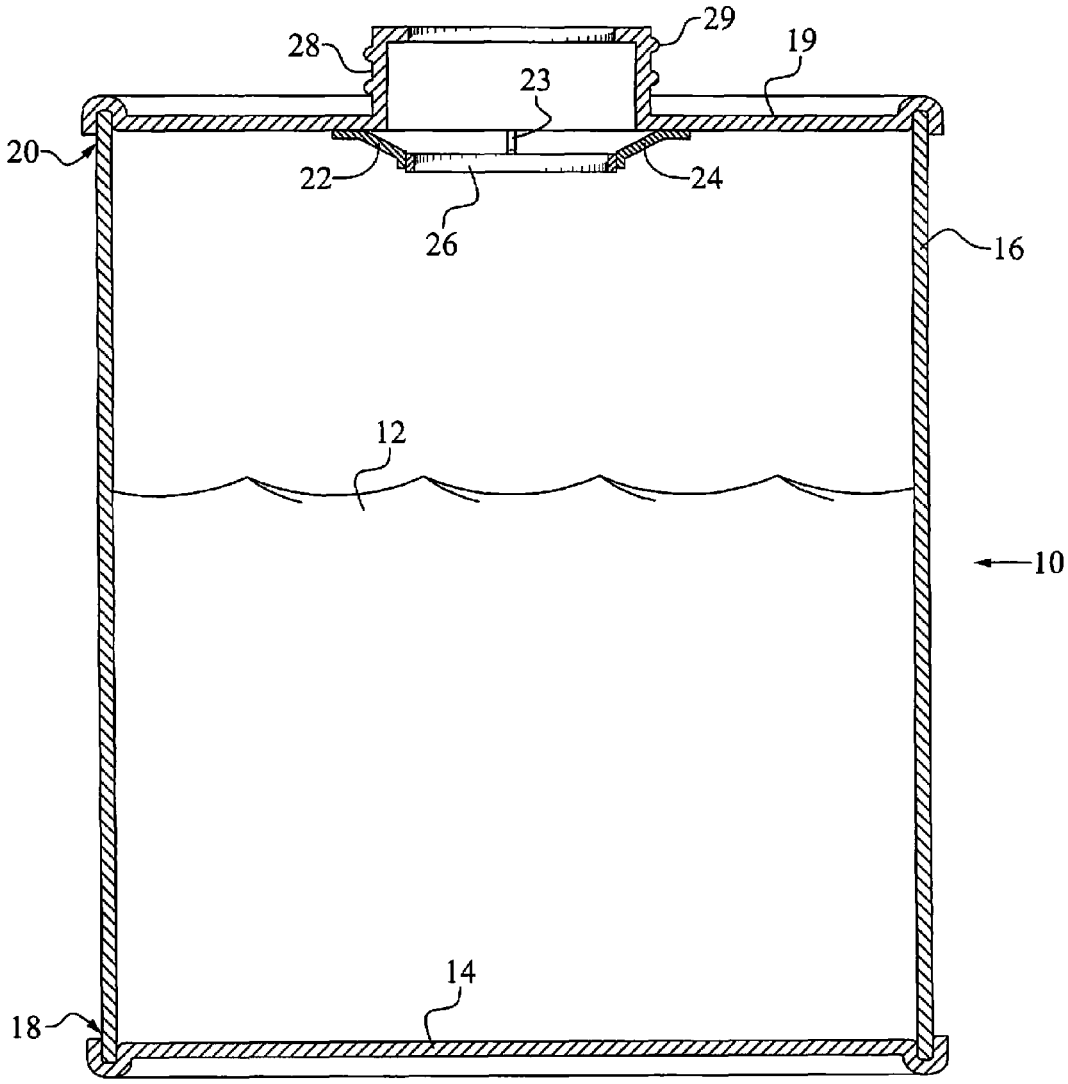
FIG. 1 shows a side cut view of a drip containing one-piece container.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a drip containing one-piece container for use with a fast curing solvent welding liquid.

In an embodiment, the fast curing solvent welding liquid can be a volatile paint, a varnish, a fast evaporating polyurethane coating, or a similar volatile chemical coating compositions.

Volatile organic chemicals, or VOC's can be stored in the drip containing one-piece container, which can reduce the toxic emissions into the environment and reduce chemical clean up costs, since fewer containers will need to be replaced, reducing the carbon footprint of a user.

The body of the container is useable for holding and/or storing the fast curing solvent welding liquid. The body has at least a bottom integrally connected to a wall at an angle between about 90 degrees to about 110 degrees. The wall has a first wall end, which engages the bottom, and a second wall end opposite the first wall end.

In an embodiment, the first and second wall ends can be integrally connected to a top opposite the bottom.

The drip containing one-piece container body can be made of tin. In another embodiment, the body can comprises a lightweight metal. The lightweight metal can be an aluminum, a bimetal, or combinations thereof.

An embodiment can contemplate that the body can be a reinforced polymer, such as crystalline homopolymers and copolymers of polypropylene, crystalline homopolymers and copolymers of polyethylene, polyvinyl chloride, or combinations thereof.

The drip containing one-piece container can be contemplated to hold between about 4 ounces to about 5 gallons of the fast curing solvent welding liquid.

A neck with neck threads extends from the top forming a first opening for allowing the fast curing solvent welding liquid to flow from the drip containing one-piece container.

A benefit of not dripping or spilling on the neck threads, can allow the container to be easily reused, since the dauber cap will not inadvertently seal the container, once the liquid dries if there is spillage.

The drip containing one-piece container has a dauber cap comprising a lid with dauber cap threads. The dauber cap threads are used for creating a sealing engagement with the neck threads. This sealing engagement provides an air tight seal between the container and the cap, which enables a longer life, or storage life of the fast curing solvent welding liquid. This reduces waste of material and saves money by not having to replace material, or liquid, which is dried out and non reusable.

The dauber cap can have a stem, which extends from a lid, and a dauber applicator can be connected to the stem opposite the lid. The dauber applicator and the stem can be stored within the drip containing one-piece container.

In an embodiment, at least two extensions extend from the neck forming at least two openings. A wiper can be disposed between the two extensions, and the wiper and the two extensions can permit the dauber applicator to rest external to the fast curing solvent welding liquid without dripping externally onto the drip containing one-piece container when not in use.

The wiper can further be disposed below the dauber cap, internal of the container.

The neck and extensions can be an integral one-piece unit with the body. Additional extensions can be used.

In an embodiment, at least four extensions can be used to support the wiper. In this embodiment, at least one opening is formed between each pair of extensions.

Two wipers can then be used across the neck and the wipers can further be in parallel to each other. The wipers can have a plurality of jagged teeth for grabbing the fast curing solvent welding liquid.

The dauber applicator retrieves a portion of the fast curing solvent welding liquid through an opening and the wiper removes portions of the fast curing solvent welding liquid allowing the fast curing solvent welding liquid to fall back into the body of the container and keep the removed portions of the fast curing solvent welding liquid from dripping externally to the container.

The container provides the benefit of once the container is closed, the fast curing solvent welding liquid will not contact a user's hands, nor will the user have to check after storage of up to twenty four hours if the liquid is dry, since dripping down the sides of the container does not occur.

This also enables the container to prevent the fast curing solvent welding liquid, or toxic materials from dripping onto the ground and polluting the environment.

The embodiments of the invention can also prevent dripping the fast curing solvent welding liquid onto tables, chairs, countertops, or surfaces of a work area and permanently damaging the surface, as the liquid dries in about 1 second to about 3 seconds, in most cases.

The invention further prevents dripping of the fast curing solvent welding liquid onto the skin and clothes of the user of the liquid while inserting and removing the dauber applicator into the fast curing solvent welding liquid, which can also prevent inadvertent ingesting of the toxic material by a user.

In an embodiment, the extensions have at least one perforation allowing for easy tearing off of the wipers from the neck without the need for tools. The wiper can be removable by a simple hand twisting, with no extra force needed, in case the user wants to remove the wiper and simply pour the liquid from the container.

In an embodiment, the extensions and the wipers can have a thickness of between about 1/64th inch to about 1/2 inch.

In an embodiment, the opening can be in the center or the container, or a ring version, which provides a container that allows the dauber cap to rest on the container and keep the fast curing solvent welding liquid in the container rather than running down the sides of the container.

In an embodiment, the wiper can be a ring forming an opening through which the dauber applicator can be wiped and supported by at least four extensions and wherein each pair of extensions form at least one opening.

In an embodiment, at least two of the openings can be half-moon shaped openings.

The drip containing one-piece container can further have at least one plate extending from the wiper towards the bottom within the container.

The embodiments provide a drip containing feature of the invention, which can reduce fire hazards during storage as well as during use. The container, which can be made of metal, will not ignite, as the container with dripped material or a fast curing solvent welding liquid down the side can ignite from a cigarette ash.

A drip containing feature of the invention is that this allows for simple, user friendly, easy to operate, no instructions needed or any special training required.

A drip containing feature of the invention is that it enables a longer life of the product in the container, less spillage so that more containers do not have to be created, and then can reduce filling of landfills with containers that had or currently have toxic chemical in them.

Turning now to the Figures. FIG. 1 shows a side cut view of a drip containing one-piece container. The drip containing one-piece container can have a body 10 for holding a fast curing solvent welding liquid 12.

The body 10 can have a bottom 14 that can be connected to a wall 16. While in this embodiment, the wall is shown in a cylindrical shape, it can be contemplated that the wall can be square shaped, rectangular shaped or another geometrical shape.

The wall 16 can have a first wall end 18 for engaging the bottom 14 and a second wall end 20 opposite the first wall end 18.

The drip containing one-piece container can have a top 19. The top 19 can connect to the second wall end 20 opposite the bottom 14.

Figure 3:
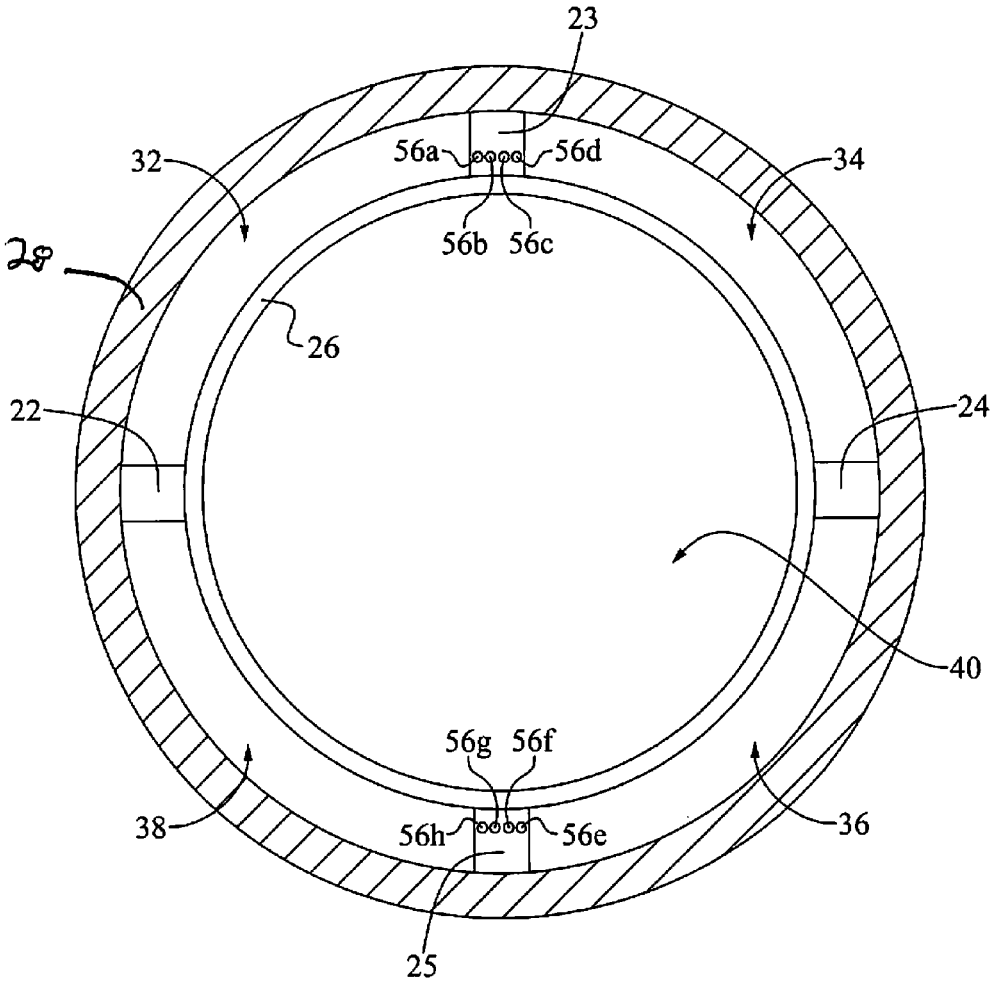
FIG. 3 shows a top cut view of the neck with a wiper.

A neck 28 can extend from the top 19 forming a first opening 32, which is shown in greater detail in FIG. 3, that can allow the fast curing solvent welding liquid 12 to flow from the drip containing one-piece container. The neck 28 can also have neck threads 29.

Extensions 22, 23 and 24 can be seen extending from the top 19 and neck 28. The extensions 22, 23 and 24 can engage a wiper 26.

While in this embodiment, the wiper 26 is shown in a ring shape, it can be contemplated that the wiper 26 can be square shaped, rectangular shaped or another geometrical shape. It can also be contemplated that in an embodiment, the wiper 26 can be hollow.

Figure 2:
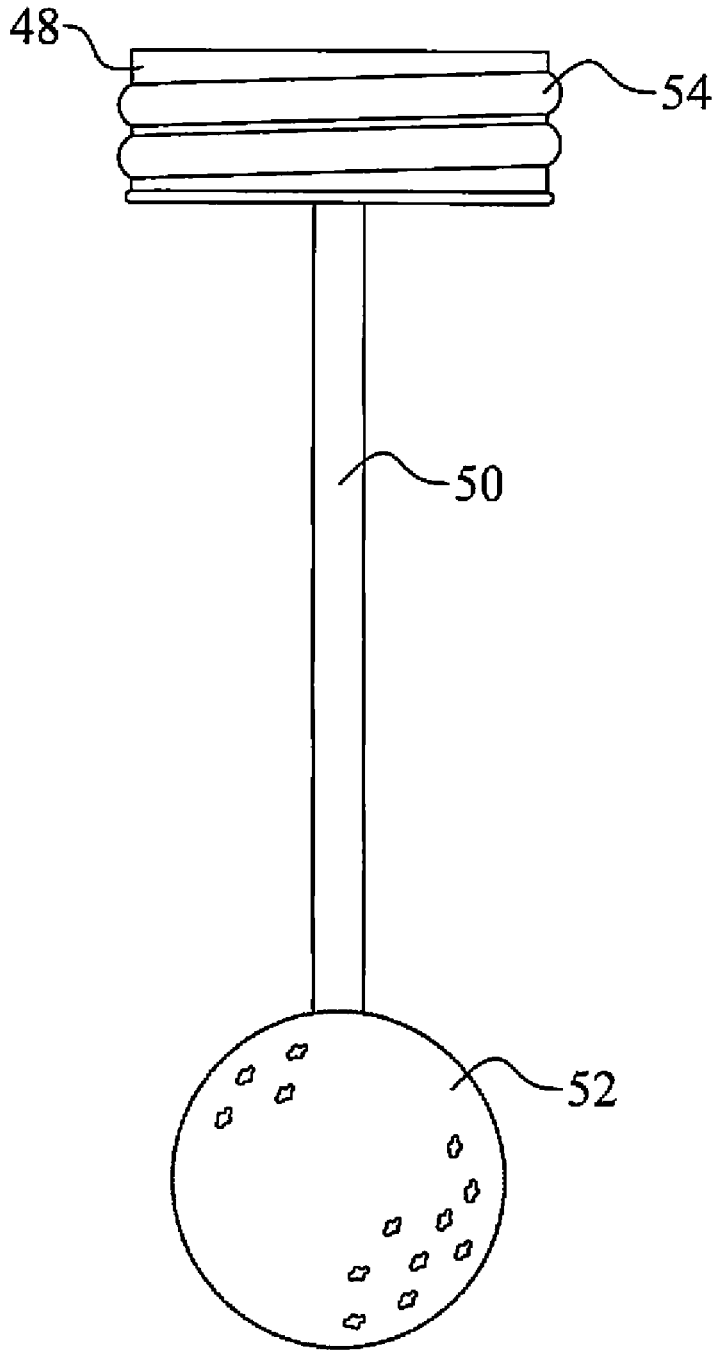
FIG. 2 shows a side view of a dauber cap.

FIG. 2 shows a side view of a dauber cap 48. The dauber cap 48 can have dauber cap threads 54 for creating a sealing engagement with the neck threads 29, as shown in FIG. 1.

A stem 50 can extend from the dauber cap 48, and a dauber applicator 52 can be connected to the stem 50 opposite the dauber cap 48.

The dauber applicator 52 can retrieve a portion of the fast curing solvent welding liquid 12, as shown in FIG. 1, through at least one of the openings 32, 34, 36 and 38, which will be described in later Figures. The wiper can remove portions of the fast curing solvent welding liquid 12, allowing the fast curing solvent welding liquid 12 to fall back into the body 10 of the drip containing one-piece container. This can prevent the removed portions of the fast curing solvent welding liquid 12 from dripping externally to the drip containing one-piece container.

The dauber applicator 52 and the stem 50 can be stored within the drip containing one-piece container when not in use.

FIG. 3 shows a top cut view of the neck 28.

Extensions 22, 23, 24 and 25 can be seen engaging the wiper 26 forming openings 32, 34, 36 and 38. While four extensions are shown in this embodiment, it can be contemplated in other embodiments, two or more extensions can be used.

It can be contemplated that the wiper 26 and the extensions 22, 23, 24 and 25 can permit the dauber applicator to rest external to the fast curing solvent welding liquid without dripping externally to the drip containing one-piece container, when not in use.

While perforations **56*a*-56*h* are depicted in the extensions 23 and 25, each of the extensions 22, 23, 24, and 25 can have at least one perforation. The perforations can allow for easy tearing off of the wiper 26** from the drip containing one-piece container without the need for tools.

Figure 4:
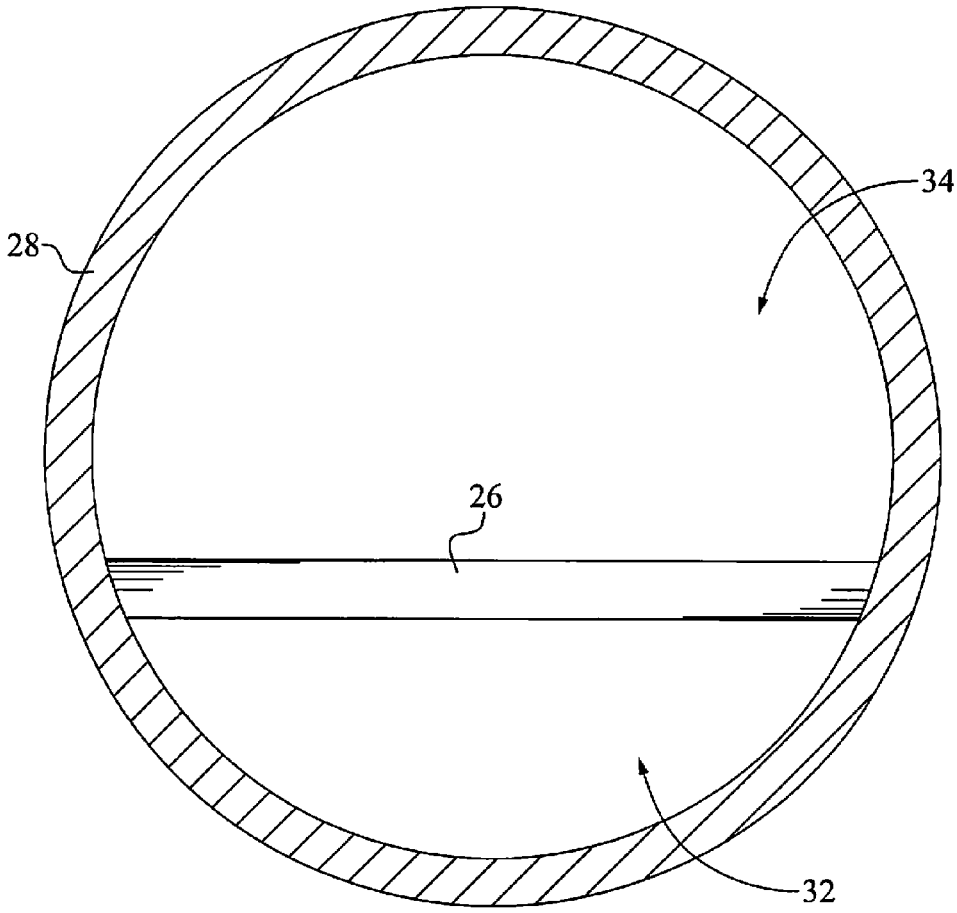
FIG. 4 shows a top cut view of the neck with an alternative embodiment of a wiper.

FIG. 4 shows a top cut view of the neck 28 with an alternative embodiment of the wiper 26. In this embodiment, the wiper 26 is shown as a single bar shaped element stretching across the neck 28.

Openings 32 and 34 can be seen in FIG. 4.

Figure 5:
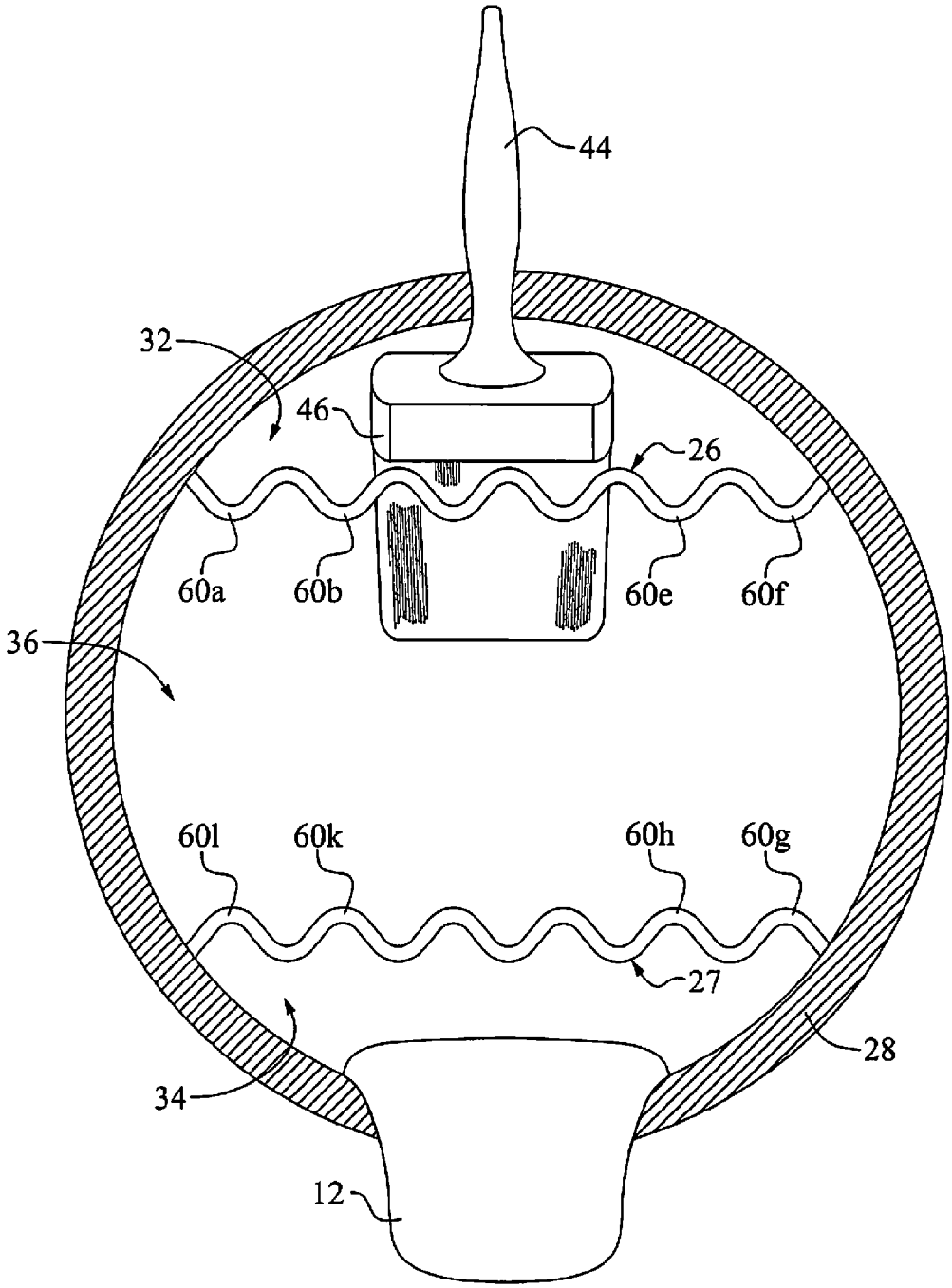
FIG. 5 shows a top cut view of the neck with two wipers.

FIG. 5 shows a top cut view of the neck 28 with two wipers. In this embodiment, two wipers 26 and 27 are shown stretching across the neck 28. The two wipers can be in parallel with each other.

The two wipers 26 and 27 can have a plurality of jagged teeth **60*a*-601 for grabbing the fast curing solvent welding liquid 12**.

In FIG. 5, the fast curing solvent welding liquid 12 can be seen being poured out of the drip containing one-piece container through the opening 34.

While these embodiments have been described with emphasis on the embodiments, it should be understood that within the scope of the appended claims, the embodiments might be practiced other than as specifically described herein.

What is claimed is:

1. A drip containing container for use with a fast curing solvent welding liquid, wherein the container comprises:

a. a body for holding a fast curing solvent welding liquid, wherein the body has a bottom integrally connected to a wall at an angle between 90 degrees to 110 degrees, and wherein the wall has a first wall end engaging the bottom and a second wall end opposite the first wall end;

b. a top detachably connected to the second wall end opposite the bottom;

c. a neck extending from the top forming a first opening for allowing the fast curing solvent welding liquid to flow from the drip containing container, wherein the neck has neck threads;

d. a dauber cap comprising a lid with dauber cap threads for creating a sealing engagement with the neck threads, wherein the dauber cap further comprises a stem extending from the lid, and a dauber applicator connected to the stem opposite the lid, and wherein the dauber applicator and the stem are stored within the drip containing container;

e. at least two extensions extending from the neck to form at least two openings, f. a wiper disposed between the at least two extensions, wherein each extension comprises at least one perforation, allowing for tearing off of the wiper from the neck without the need for tools wherein the wiper and the at least two extensions permit the dauber applicator to rest external to the fast curing solvent welding liquid without dripping externally to the drip containing container when not in use; and g. wherein the dauber applicator is configured to retrieve a portion of the fast curing solvent welding liquid through at least one of the at least two openings and the wiper is configured to remove portions of the fast curing solvent welding liquid, allowing the fast curing solvent welding liquid to fall back into the body from the wiper, thereby preventing the removed portions of the fast curing solvent welding liquid from dripping externally to the drip containing container.

2. The drip containing container of claim 1, wherein the fast curing solvent welding liquid is selected from the group consisting of: a volatile paint, a varnish, a fast evaporating polyurethane coating, and a volatile chemical coating composition.

3. The drip containing container of claim 1, wherein the body is made of tin.

4. The drip containing container of claim 1, wherein the body comprises a lightweight metal selected from the group consisting of aluminum and bimetal.

5. The drip containing container of claim 1, wherein the body comprises a reinforced polymer selected from the group consisting of: a crystalline homopolymer and copolymers of polypropylene, crystalline homopolymers and copolymers of polyethylene, and polyvinyl chloride.

6. The drip containing container of claim 1, wherein the container is configured to hold between 4 ounces to 5 gallons of the fast curing solvent welding liquid.

7. The drip containing container of claim 1, further comprising at least four extensions supporting the wiper, wherein at least one opening is formed between each of the at least two extensions.

8. The drip containing container of claim 1, wherein each of the at least two extensions and the wiper has a thickness between 1/64th inch to 1/2 inch.

9. The drip containing container of claim 7, wherein the wiper is a ring forming an opening through which the dauber applicator is capable of being wiped and supported by the at least four extensions.

10. The drip containing container of claim 1, wherein the at least two openings comprise at least two connected half-moon shaped openings.

* * * * *